US006480823B1

(12) United States Patent
Zhao et al.

(10) Patent No.: US 6,480,823 B1
(45) Date of Patent: Nov. 12, 2002

(54) SPEECH DETECTION FOR NOISY CONDITIONS

(75) Inventors: Yi Zhao, Goleta, CA (US); Jean-Claude Junqua, Santa Barbara, CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/047,276

(22) Filed: Mar. 24, 1998

(51) Int. Cl.[7] ..... G10L 21/02
(52) U.S. Cl. ..... 704/226; 704/214; 704/233
(58) Field of Search ..... 704/208, 209, 704/210, 214, 215, 226, 233, 248, 253

(56) References Cited

U.S. PATENT DOCUMENTS

| | | | | | |
|---|---|---|---|---|---|
| 4,032,711 | A | | 6/1977 | Sambur | |
| 4,052,568 | A | * | 10/1977 | Jankowski | 704/233 |
| 4,357,491 | A | * | 11/1982 | Daaboul et al. | 704/233 |
| 4,401,849 | A | | 8/1983 | Ichikawa et al. | |
| 4,410,763 | A | | 10/1983 | Strawczynski et al. | |
| 4,433,435 | A | | 2/1984 | David | |
| 4,531,228 | A | | 7/1985 | Noso et al. | |
| 4,535,473 | A | * | 8/1985 | Sakata | 704/248 |
| 4,552,996 | A | | 11/1985 | de Bergh | |
| RE32,172 | E | | 6/1986 | Johnston et al. | |
| 4,627,091 | A | | 12/1986 | Fedele | |
| 4,630,304 | A | * | 12/1986 | Borth et al. | 381/94 |
| 4,696,041 | A | | 9/1987 | Sakata | |
| 4,718,097 | A | | 1/1988 | Uenoyama | |
| 4,815,136 | A | | 3/1989 | Benvenuto | |
| 5,151,940 | A | | 9/1992 | Okazaki et al. | |
| 5,222,147 | A | | 6/1993 | Koyama | |
| 5,305,422 | A | | 4/1994 | Janqua | |
| 5,313,531 | A | * | 5/1994 | Jackson | 704/243 |
| 5,323,337 | A | | 6/1994 | Wilson et al. | |
| 5,479,560 | A | * | 12/1995 | Mekata | 704/209 |
| 5,579,431 | A | * | 11/1996 | Reaves | 704/214 |
| 5,617,508 | A | * | 4/1997 | Reaves | 704/233 |
| 5,649,055 | A | * | 7/1997 | Gupta et al. | 704/233 |
| 6,038,532 | A | * | 3/2000 | Kane et al. | 704/233 |
| 6,266,633 | B1 | * | 7/2001 | Higgins et al. | 704/224 |

FOREIGN PATENT DOCUMENTS

| | | | | |
|---|---|---|---|---|
| EP | A2 0 322 797 | | 7/1989 | |
| WO | WO 86/00133 | * | 1/1986 | G10L/5/00 |

OTHER PUBLICATIONS

IBM Technical Disclosure Bulletin; Dynamic Adjustment of Silence/Speech Threshold in varying Noise conditions. vol. 37, pp. 329–330; Jun. 1, 1994.*

Lori F. Lamel, et al, "An Improved Endpoint Detector for Isolated Word Regognition", IEEE Transactions on Acoustics, Speech, and Signal Processing, vol. ASSP–29, No. 4, Aug. 1981.

A. Acero et al., Robust HMM–Based Endpoint Detector, 1993, 1551–1554.

M. Rangoussi et al., Robust Endpoint Detection of Speech in the Presence of Noise, 1993, 649–651.

J. G. Wilpon et al., Application of Hidden Markov Models to Automatic Speech Endpoint Detection, 1987, 321–341.

* cited by examiner

*Primary Examiner*—Marsha D. Banks-Harold
*Assistant Examiner*—Abul K. Azad
(74) *Attorney, Agent, or Firm*—Harness, Dickey & Pierce, P.L.C.

(57) ABSTRACT

The input signal is transformed into the frequency domain and then subdivided into bands corresponding to different frequency ranges. Adaptive thresholds are applied to the data from each frequency band separately. Thus the short-term band-limited energies are tested for the presence or absence of a speech signal. The adaptive threshold values are independently updated for each of the signal paths, using a histogram data structure to accumulate long-term data representing the mean and variance of energy within the respective frequency band. Endpoint detection is performed by a state machine that transitions from the speech absent state to the speech present state, and vice versa, depending on the results of the threshold comparisons. A partial speech detection system handles cases in which the input signal is truncated.

16 Claims, 9 Drawing Sheets

SPEECH DETECTION FOR NOISY CONDITIONS

BACKGROUND AND SUMMARY OF THE INVENTION

The present invention relates generally to speech processing and speech recognizing systems. More particularly, the invention relates to a detection system for detecting the beginning and ending of speech within an input signal.

Automated speech processing, for speech recognition and for other purposes, is currently one of the most challenging tasks a computer can perform. Speech recognition, for example, employs a highly complex pattern-matching technology that can be very sensitive to variability. In consumer applications, recognition systems need to be able to handle a diverse range of different speakers and need to operate under widely varying environmental conditions. The presence of extraneous signals and noise can greatly degrade recognition quality and speech-processing performance.

Most automated speech recognition systems work by first modeling patterns of sound and then using those patterns to identify phonemes, letters, and ultimately words. For accurate recognition, it is very important to exclude any extraneous sounds (noise) that precede or follow the actual speech. There are some known techniques that attempt to detect the beginning and ending of speech, although there still is considerable room for improvement.

The present invention divides the incoming signal into frequency bands, each band representing a different range of frequencies. The short-term energy within each band is then compared with a plurality of thresholds and the results of the comparison are used to drive a state machine that switches from a "speech absent" state to a "speech present" state when the band-limited signal energy of at least one of the bands is above at least one of its associated thresholds. The state machine similarly switches from a "speech present" state to a "speech absent" state when the band-limited signal energy of at least one of the bands is below at least one of its associated thresholds. The system also includes a partial speech detection mechanism based on an assumed "silence segment" prior to the actual beginning of speech.

A histogram data structure accumulates long-term data concerning the mean and variance of energy within the frequency bands, and this information is used to adjust adaptive thresholds. The frequency bands are allocated based on noise characteristics. The histogram representation affords strong discrimination between speech signal, silence and noise, respectively. Within the speech signal itself, the silence part (with only background noise) typically dominates, and it is reflected strongly on the histogram. Background noise, being comparatively constant, shows up as noticeable spikes on the histogram.

The system is well adapted to detecting speech in noisy conditions and it will detect both the beginning and end of speech as well as handling situations where the beginning of speech may have been lost through truncation.

For a more complete understanding of the invention, its objects and advantages, reference may be had to the following specification and to the accompanying drawings.

DESCRIPTION OF THE PREFERRED EMBODIMENT

Figure 1:
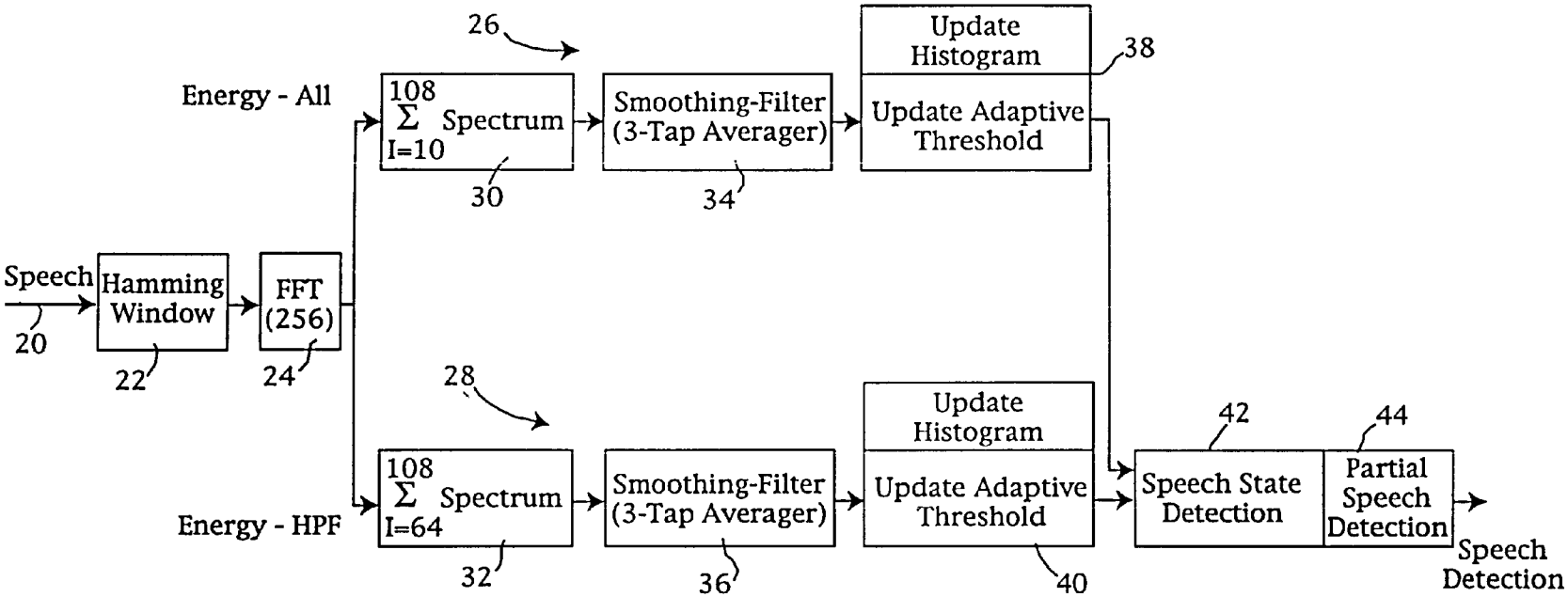
FIG. 1 is a block diagram of the speech detection system in a presently preferred, 2-band embodiment.

The present invention separates the input signal into multiple signal paths, each representing a different frequency band. FIG. 1 illustrates one embodiment of the invention employing two bands, one band corresponding to the entire frequency spectrum of the input signal and the other band corresponding to a high frequency subset of the entire frequency spectrum. The illustrated embodiment is particularly suited to examining input signals having a low signal-to-noise ratio (SNR), such as for conditions found within a moving motor vehicle or within a noisy office environment. In these common environments, much of the noise energy is distributed below 2,000 Hz.

While a two-band system is illustrated here, the invention can be extended readily to other multi-band arrangements. In general, the individual bands cover different ranges of frequencies, designed to isolate the signal (speech) from the noise. The current implementation is digital. Of course, analog implementations could also be made using the description contained herein.

Referring to FIG. 1, the input signal containing a possible speech signal as well as noise has been represented at 20. The input signal is digitized and processed through a hamming window 22 to subdivide the input signal data into frames. The presently preferred embodiment employs a 10 ms frame of a predefined sampling rate (in this case 8,000 Hz.), resulting in 80 digital samples per frame. The illustrated system is designed to operate upon input signals having a frequency spread in the range of 300 Hz. to 3,400 Hz. Thus a sampling rate of twice the upper frequency limit ($2\times4{,}000=8{,}000$) has been selected. If a different frequency content is found in the information-conveying part of the input signal, then the sampling rate and frequency bands can be adjusted appropriately.

The output of hamming window 22 is a sequence of digital samples representing the input signal (speech plus noise) and arranged into frames of a predetermined size. These frames are then fed to the fast Fourier transform (FFT) converter 24, which transforms the input signal data from the time domain into the frequency domain. At this point the signal is split into plural paths, a first path at 26 and a second path at 28. The first path corresponds to a frequency band containing all frequencies of the input signal, while the second path 28 corresponds to a high-frequency subset of the full spectrum of the input signal. Because the frequency domain content is represented by digital data, the frequency band splitting is accomplished by the summation modules 30 and 32, respectively.

Note that the summation module 30 sums the spectral components over the range 10–108; whereas the summation module 32 sums over the range 64–108. In this way, the summation module 30 selects all frequency bands in the input signal, while module 32 selects only the high-frequency bands. In this case, module 32 extracts a subset of the bands selected by module 30. This is the presently preferred arrangement for detecting speech content within a noisy input signal of the type commonly found in moving vehicles or noisy offices. Other noisy conditions may dictate other frequency band-splitting arrangements. For example, plural signal paths could be configured to cover individual, nonoverlapping frequency bands and partially overlapping frequency bands, as desired.

The summation modules 30 and 32 sum the frequency components one frame at a time. Thus the resultant outputs of modules 30 and 32 represent frequency band-limited, short-term energy within the signal. If desired, this raw data may be passed through a smoothing filter, such as filters 34 and 36. In the presently preferred embodiment a 3-tap average is used as the smoothing filter in both locations.

As will be more fully explained below, speech detection is based on comparing the multiple frequency band-limited, short-term energy with a plurality of thresholds. These thresholds are adaptively updated based on the long-term mean and variance of energies associated with the pre-speech silence portion (assumed to be present while the system is active but before the speaker begins speaking). The implementation uses a histogram data structure in generating the adaptive thresholds. In FIG. 1 composite blocks 38 and 40 represent the adaptive threshold updating modules for signal paths 26 and 28, respectively. Further details of these modules will be provided in connection with FIG. 2 and several of the associated waveform diagrams.

Although separate signal paths are maintained downstream of the fast Fourier transform module 24, through the adaptive threshold updating modules 38 and 40, the ultimate decision on whether speech is present or absent in the input signal results from considering both signal paths together. Thus the speech state detection modules 42 and its associated partial speech detection module 44 consider the signal energy data from both paths 26 and 28. The speech state module 42 implements a state machine whose details are further illustrated in FIG. 4. The partial speech detection module is shown in greater detail in FIG. 3.

Figure 2:
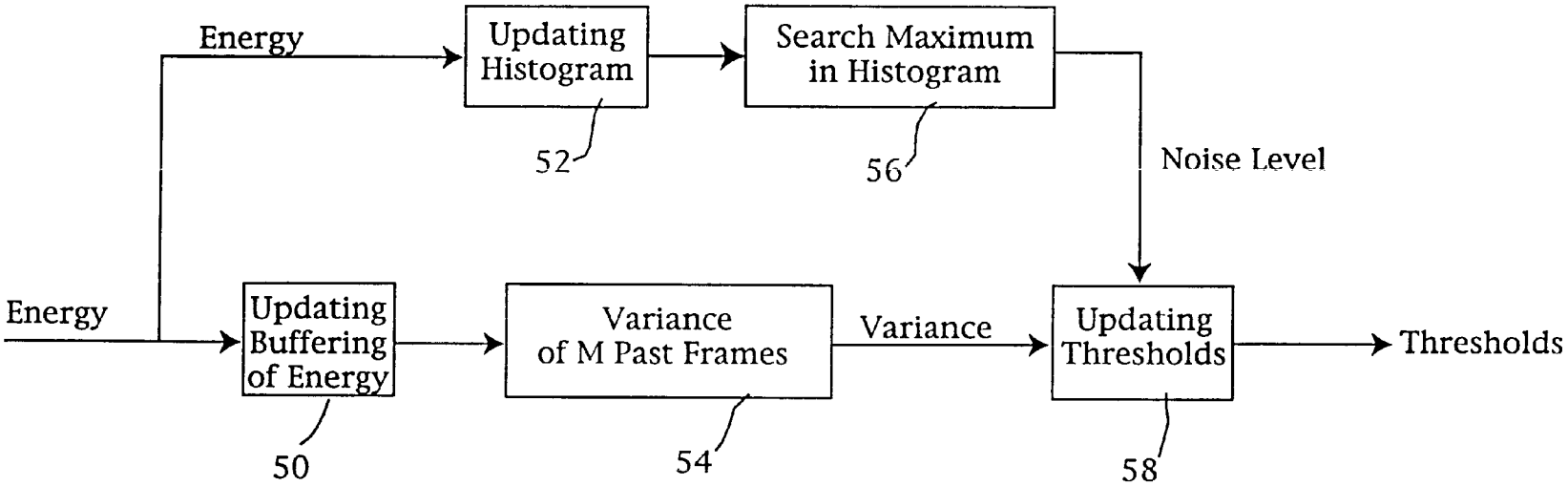
FIG. 2 is a detailed block diagram of the system used to adjust the adaptive thresholds.

Referring now to FIG. 2, the adaptive threshold updating module 38 will be explained. The presently preferred implementation uses three different thresholds for each energy band. Thus in the illustrated embodiment there is a total of six thresholds. The purpose of each threshold will be made more clear by considering the waveform diagrams and the associated discussion. For each energy band the three thresholds are identified: Threshold, WThreshold and SThreshold. The first listed threshold, Threshold, is a basic threshold used for detecting the beginning of speech. The WThreshold is a weak threshold for detecting the ending of speech. The SThreshold is a strong threshold for assessing the validity of the speech detection decision. These thresholds are more formally defined as follows:

Threshold=Noise_Level+Offset

*W*Threshold=Noise_Level+OffsetR*1; (*R*1**=0.2 . . . 1, 0.5 being presently preferred)

*S*Threshold=Noise_Level+OffsetR*2; (*R*2**=1 . . . 4, 2 being presently preferred)

Where:

Noise_Level is the long term mean, i.e., the maximum of all past input energies in the histogram.

Offset=Noise_Level*R3+Variance*R4; (R3=0.2 . . . 1, 0.5 being presently preferred; R4=2 . . . 4, 4 being presently preferred).

Variance is the short term variance, i.e., the variance of M past input frames.

Figure 5:
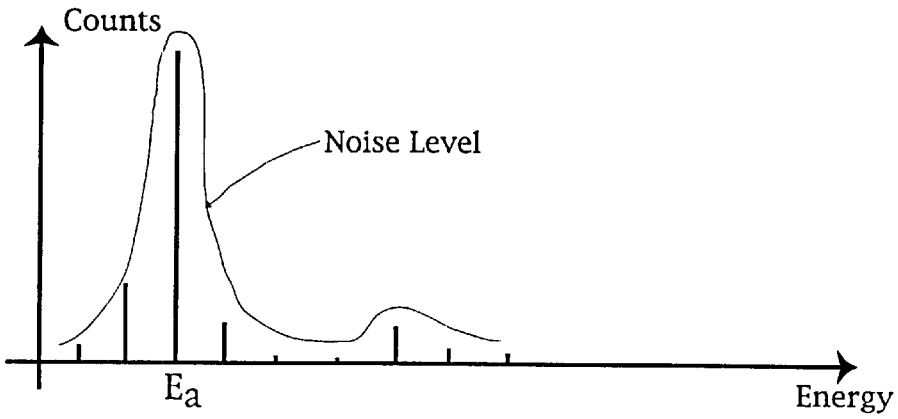
FIG. 5 is a graph illustrating an exemplary histogram, useful in understanding the invention.
Figure 6:
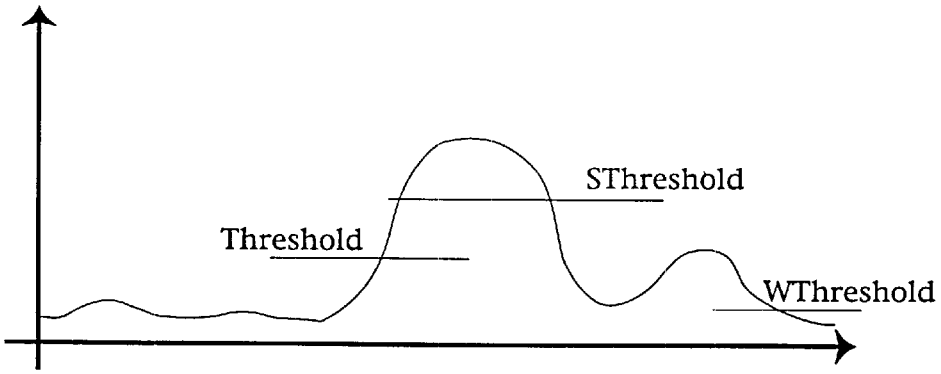
FIG. 6 is a waveform diagram illustrating the plurality of thresholds used in comparing signal energies for speech detection.

FIG. 6 illustrates the relationship of the three thresholds superimposed upon an exemplary signal. Note that SThreshold is higher than Threshold, while WThreshold is generally lower than Threshold. These thresholds are based on the noise level using a histogram data structure to determine the maximum of all past input energies contained within the pre-speech silence portion of the input signal. FIG. 5 illustrates an exemplary histogram superimposed upon a waveform illustrating an exemplary noise level. The histogram records as "Counts" the number of times the pre-speech silence portion contains a predetermined noise level energy. The histogram thus plots the number of counts (on the y-axis) as a function of the energy level (on the x-axis). Note that in the example illustrated in FIG. 5, the most common (highest count) noise level energy has an energy value of $E_a$. The value $E_a$ would correspond to a predetermined noise level energy.

The noise level energy data recorded in the histogram (FIG. 5) is extracted from the pre-speech silence portion of the input signal. In this regard, it is assumed that the audio channel supplying the input signal is live and sending data to the speech detection system before actual speech commences. Thus in this pre-speech silence region, the system is effectively sampling the energy characteristics of the ambient noise level itself.

The presently preferred implementation uses a fixed size histogram to reduce computer memory requirements. Proper configuration of the histogram data structure represents a tradeoff between the desire for precise estimation (implying small histogram steps) and wide dynamic range (implying large histogram steps). To address the conflict between precise estimation (small histogram step) and wide dynamic range (large histogram step) the current system adaptively adjusts histogram step based on actual operating conditions. The algorithm employed in adjusting histogram step size is described in the following pseudocode, where M is the step size (representing a range of energy values in each step of the histogram).

The pseudocode for the adaptive histogram step

```
After the initialization stage:
Compute mean of the past frames inside buffers
M=tenth of the previous said mean
If (M<MIN_HISTOGRAM_STEP)
  M=MIN_HISTOGRAM_STEP
End
```

In the above pseudocode, note that the histogram step M is adapted based on mean of the assumed silence part at the beginning that are buffered in the initialization stage. The said mean is assumed to show the actual background noise conditions. Note that the histogram step is limited to MIN_HISTOGRAM_STEP as a lower bound. This histogram step is fixed after this moment.

The histogram is updated by inserting a new value for each frame. To adapt to the slow changing background noise, a forgetting factor (in the current implementation 0.90) is introduced for every 10 frames.

The pseudocode for updating the histogram

```
If (value<HISTOGRAM_SIZE*M)
{
  //update histogram by forgetting factor
  if(frame_in_histogram % 10==0)
  {
    for(I=0;I<HISTOGRAM_SIZE;I++)
    histogram[1]*=HISTOGRAM_FORGETTING_
      FACTOR;
  }
  //update histogram by inserting new value
  histogram[value+M/2)/M]+=1;
  histogram[value−M/2)M}+=1;
    }
```

Referring now to FIG. 2, the basic block diagram of the adaptive threshold updating mechanism is illustrated. This block diagram illustrates the operations performed by modules 38 and 40 (FIG. 1). The short-term (current data) energy is stored in update buffer 50 and is also used in module 52 to update the histogram data structure as previously described.

The update buffer is then examined by module 54 which computes the variance over the past frames of data stored in buffer 50.

Meanwhile, module 56 identifies the maximum energy value within the histogram (e.g., value $E_a$ in FIG. 5) and supplies this to the threshold updating module 58. The threshold updating module uses the maximum energy value and the statistical data (variance) from module 54 to revise the primary threshold, Threshold. As previously discussed, Threshold is equal to the noise level plus a predetermined offset. This offset is based on the noise level as determined by the maximum value in the histogram and upon the variance supplied by module 54. The remaining thresholds, WThreshold and SThreshold, are calculated from Threshold according to the equations set forth above.

Figure 12:
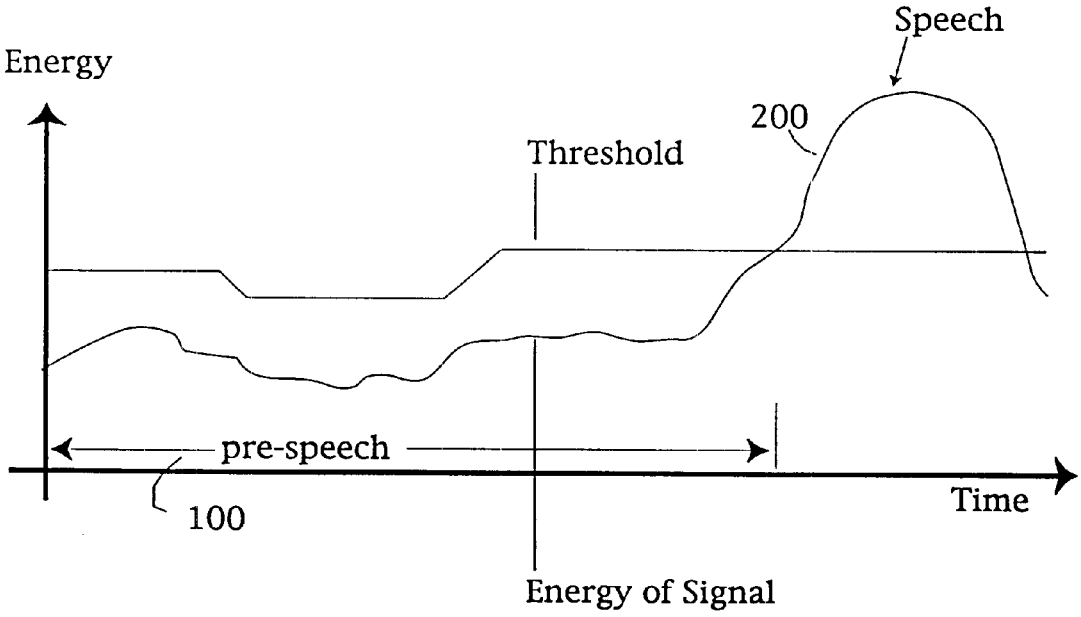
FIG. 12 illustrates the performance of the adaptive threshold as it adapts to the background noise level.

In normal operation, the thresholds adaptively adjust, generally tracking the noise level within the pre-speech region. FIG. 12 illustrates this concept. In FIG. 12 the pre-speech region is shown at 100 and the beginning of speech is shown generally at 200. Upon this waveform the Threshold level has been superimposed. Note that the level of this threshold tracks the noise level within the pre-speech region, plus an offset. Thus the Threshold (as well as the SThreshold and the WThreshold) applicable to a given speech segment will be those thresholds in effect immediately prior to the beginning of speech.

Referring back to FIG. 1, the speech state detection and partial speech detection modules 42 and 44 will now be described. Instead of making the speech present/speech absent decision based on one frame of data, the decision is made based on the current frame plus a few frames following the current frame. With regard to beginning of speech detection, the consideration of additional frames following the current frame (look ahead) avoids the false detection in the presence of a short but strong noise pulse, such as an electric pulse. With regard to ending of speech detection, frame look ahead prevents a pause or short silence in an otherwise continuous speech signal from providing a false detection of the end of speech. This delayed decision or look ahead strategy is implemented by buffering the data in the update buffer 50 (FIG. 2) and applying the process described by the following pseudocode:

```
Begin_speech test:
  Beginning Delayed Decision=FALSE
  Loop M following frames (M=3; 30 ms)
    If Either (Energy_All) OR (Energy_HPF)
      >Threshold
        Then Beginning Delayed Decision=TRUE
End_of_speech test:
  Ending Delayed Decision=FALSE
  Loop N following frames (N=30; 300 ms)
    If Both (Energy_All) AND (Energy_HPF)
      <Threshold
        Then Ending Delayed Decision=TRUE
  End of Loop
```

Figure 7:
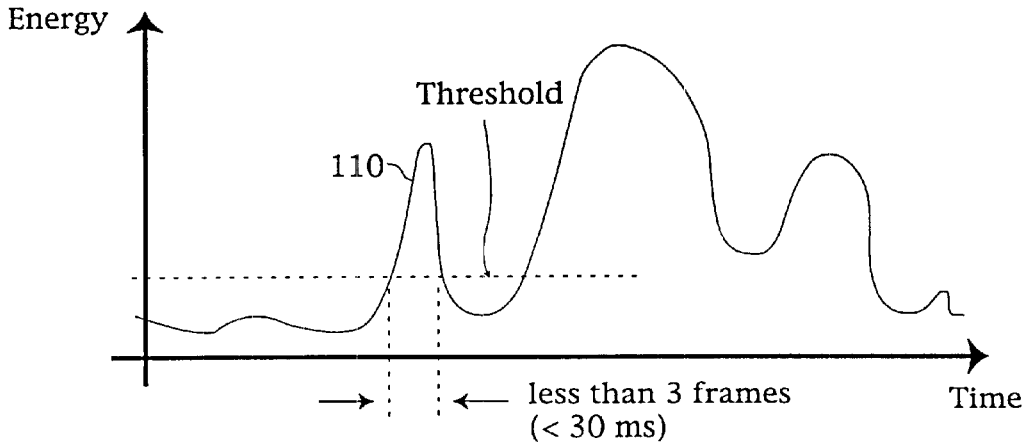
FIG. 7 is a waveform diagram illustrating the beginning speech delayed detection mechanism used to avoid misdetection of strong noise pulses.
Figure 8:
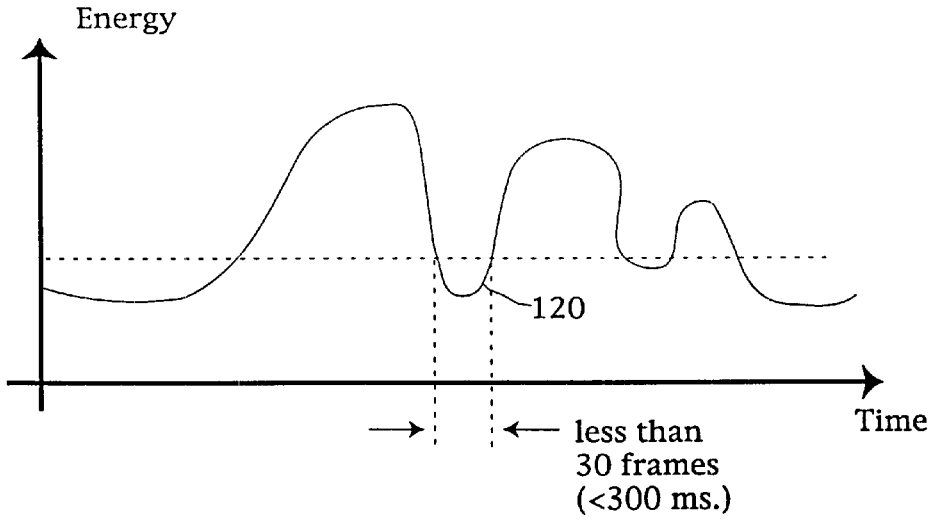
FIG. 8 is a waveform diagram illustrating the end of speech delayed decision mechanism used to allow a pause inside of continuous speech.

See FIG. 7 which illustrates how the 30 ms delay in the Begin_speech test avoids false detection of a noise spike 110 above the threshold. Also see FIG. 8 which illustrates how the 300 ms delaying the End_of_speech test prevents a short pause 120 in the speech signal from triggering the end-of-speech state.

The above pseudocode sets two flags, the Beginning Delayed Decision flag and the Ending Delayed Decision flag. These flags are used by the speech signal state machine shown in FIG. 4. Note that the beginning of speech uses a 30 ms delay, corresponding to three frames (M=3). This is normally adequate to screen out false detection due to short noise spikes. The ending uses a longer delay, on the order of 300 ms, which has been found to adequately handle normal pauses occurring inside connected speech. The 300 ms delay corresponds to 30 frames (N=30). To avoid errors due to clipping or chopping of the speech signal, the data may be padded with additional frames based on the detected speech portion for both the beginning and ending.

The beginning of speech detection algorithm assumes the existence of a pre-speech silence portion of at least a given minimum length. In practice, there are times when this assumption may not be valid, such as in cases where the input signal is clipped due to signal dropout or circuit switching glitches, thereby shortening or eliminating the assumed "silence segment." When this occurs, the thresholds may be adapted incorrectly, as the thresholds are based on noise level energy, presumably with voice signal absent. Furthermore, when the input signal is clipped to the point that there is no silence segment, the speech detection system could fail to recognize the input signal as containing speech, possibly resulting in a loss of speech in the input stage that makes the subsequent speech processing useless.

Figure 3:
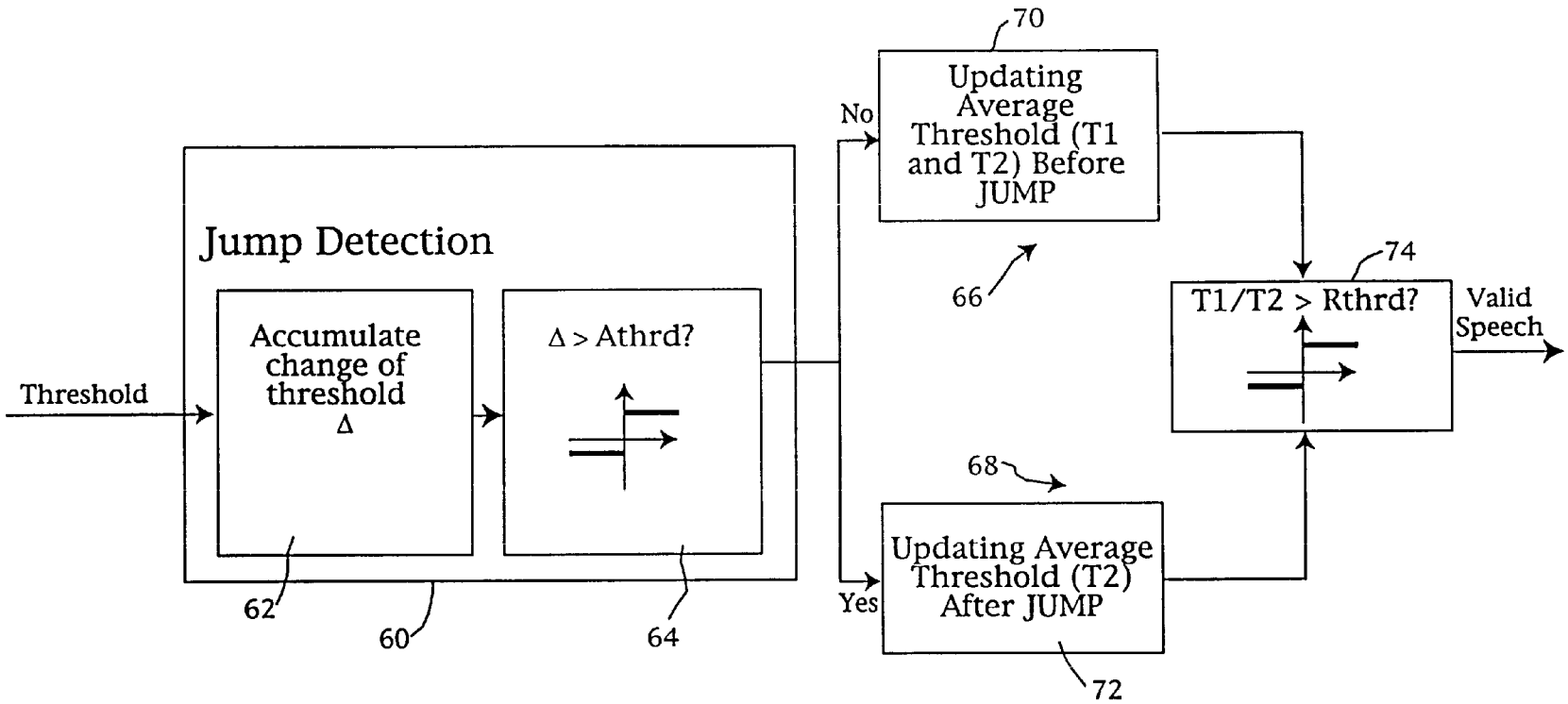
FIG. 3 is a detailed block diagram of the partial speech detection system.

To avoid the partial speech condition, a rejection strategy is employed as illustrated in FIG. 3. FIG. 3 illustrates the mechanism employed by partial speech detection module 44 (FIG. 1). The partial speech detection mechanism works by monitoring the threshold (Threshold) to determine if there is a sudden jump in the adaptive threshold level. The jump detection module 60 performs this analysis by first accumulating a value indicative of the change in threshold over a series of frames. This step is performed by module 62 which generates accumulated threshold change Δ. This accumulated threshold change Δ is compared with a predetermined absolute value Athrd in module 64, and the processing proceeds through either branch 66 or branch 68, depending on whether Δ is greater than Athrd or not. If not, module 70 is invoked (if so module 72 is invoked). Modules 70 and 72 maintain separate average threshold values. Module 70 maintains and updates threshold value T1, corresponding to threshold values before the detected jump and module 72 maintains and updates Threshold 2 corresponding to thresholds after the jump. The ratio of these two thresholds (T1/T2) is then compared with a third threshold Rthrd in module 74. If the ratio is greater than the third threshold then a ValidSpeech flag is set. The ValidSpeech flag is used in the speech signal state machine of FIG. 4.

Figure 9A:
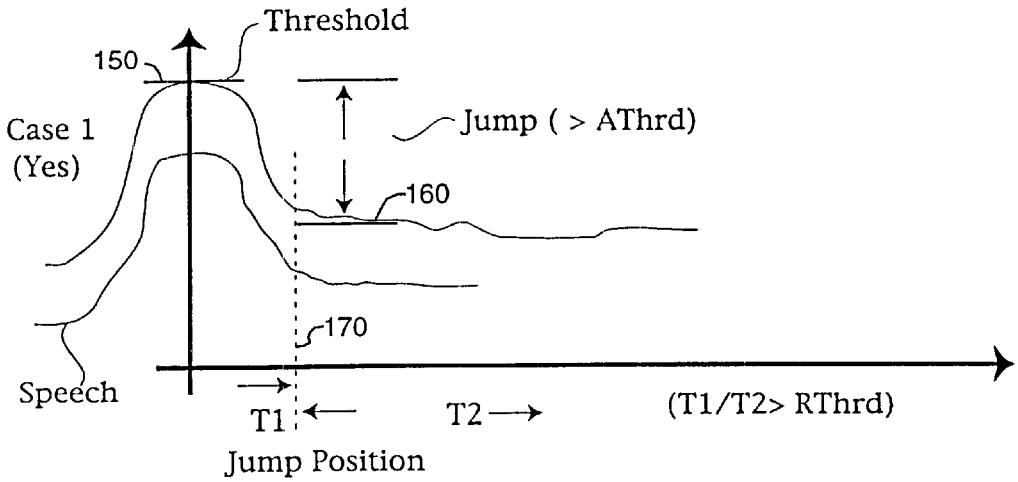
FIG. 9A is a waveform diagram illustrating one aspect of the partial speech detection mechanism.
Figure 9B:
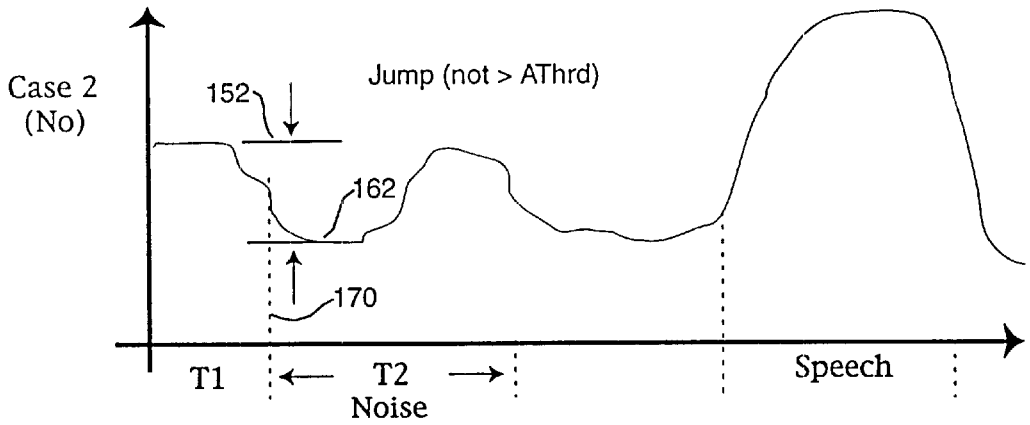
FIG. 9B is a waveform diagram illustrating another aspect of the partial speech detection mechanism.

FIGS. 9A and 9B illustrate the partial speech detection mechanism in operation. FIG. 9A corresponds to a condition that would take the Yes branch 68 (FIG. 3), whereas FIG. 9B corresponds to a condition that would take the No branch 66. Referring to FIG. 9A note that there is a jump in the threshold from 150 to 160. In the illustrated example this jump is greater than the absolute value Athrd. In FIG. 9B the jump in threshold, from position 152 to position 162 represents a jump that is not greater than Athrd. In both FIGS. 9A and 9B the jump position has been illustrated by the dotted line 170. The average threshold value before the jump position is designated T1 and the average threshold after the jump position is designated T2. The ratio T1/T2 is then compared with the ratio threshold Rthrd (block 74 in FIG. 3). ValidSpeech is discriminated from simply stray noise in the pre-speech region as follows. If the jump in threshold is less than Athrd, or if the ratio T1/T2 is less than Rthrd then the signal responsible for the threshold jump is recognized as noise. On the other hand, if the ratio T1/T2 is greater than Rthrd then the signal responsible for the threshold jump is treated as partial speech and it is not used to update the threshold.

Figure 4:
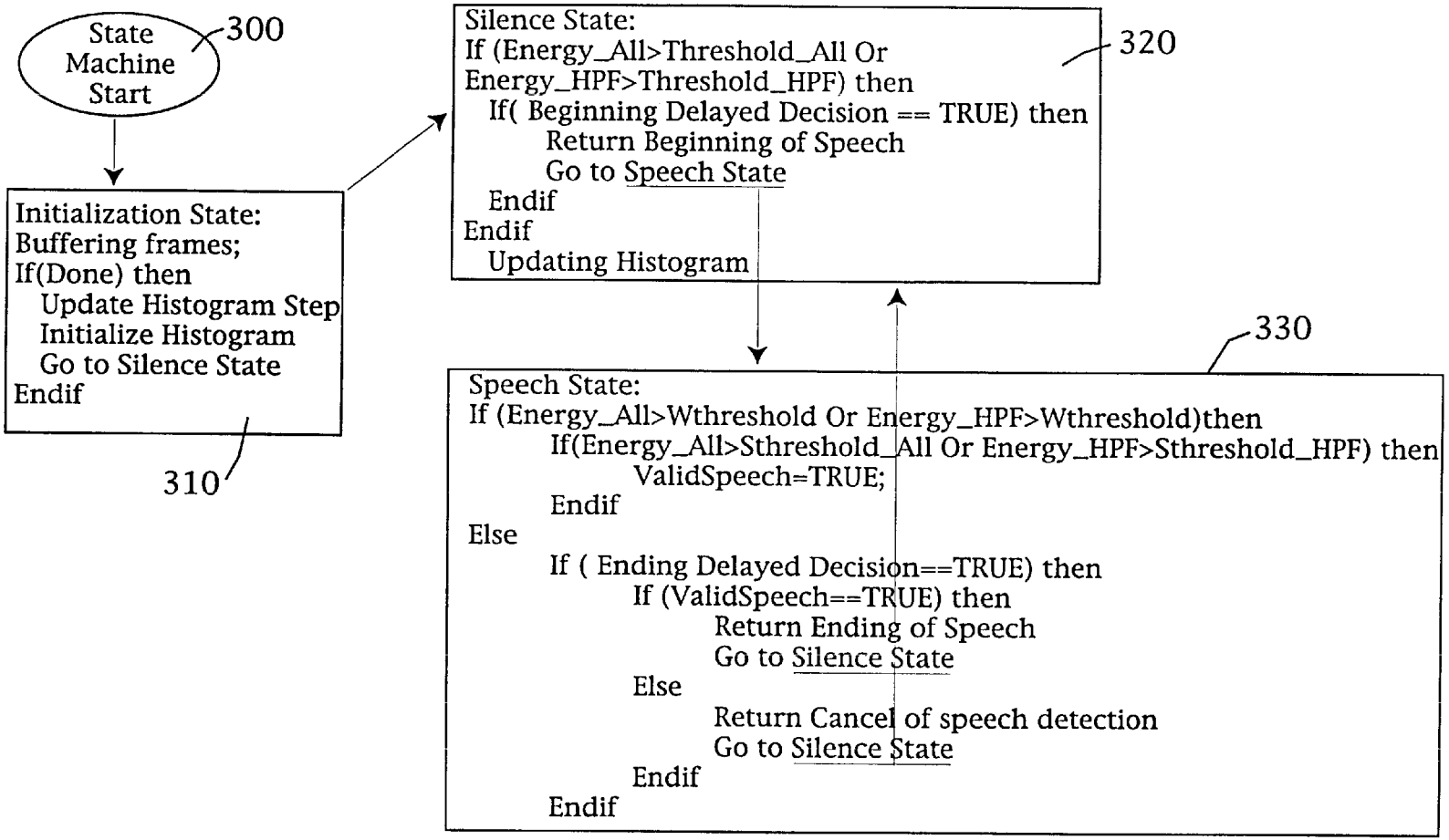
FIG. 4 illustrates the speech signal state machine of the invention.

Referring now to FIG. 4, the speech signal state machine starts, as indicated at 300 in the initialization state 310. It then proceeds to the silence state 320, where it remains until the steps performed in the silence state dictate a transition to the speech state 330. Once in the speech state 330, the state machine will transition back to the silence state 320 when certain conditions are met as indicated by the steps illustrated within the speech state 330 block.

In initialization state 310 frames of data are stored in buffer 50 (FIG. 2) and the histogram step size is updated. It will be recalled that the preferred embodiment begins operation with a nominal step size M=20. This step size may be adapted during the initialization state as described by the pseudocode provided above. Also during the initialization state the histogram data structure is initialized to remove any previously stored data from earlier operation. After these steps are performed the state machine transitions to silence state 320.

In the silence state each of the frequency band-limited short-term energy values is compared with the basic threshold, Threshold. As previously noted, each signal path has its own set of thresholds. In FIG. 4 the threshold applicable to signal path 26 (FIG. 1) is designated Threshold_All and the threshold applicable to signal path 28 is designated Threshold_HPF. Similar nomenclature is used for the other threshold values applied in speech state 330.

If either one of the short-term energy values exceeds its threshold then the Beginning Delayed Decision flag is tested. If that flag was set to TRUE, as previously discussed, a Beginning of Speech message is returned and the state machine transitions to the speech state 330. Otherwise, the state machine remains in the silent state and the histogram data structure is updated.

The presently preferred embodiment updates the histogram using a forgetting factor of 0.99 to cause the effect of noncurrent data to evaporate over time. This is done by multiplying existing values in the histogram by 0.99 prior to adding the Count data associated with current frame energy. In this way, the effect of historical data is gradually diminished over time.

Processing within the speech state 330 proceeds along similar lines, although different sets of threshold values are used. The speech state compares the respective energies in signal paths 26 and 28 with the WThresholds. If either signal path is above the WThreshold then a similar comparison is made vis-a-vis the SThresholds. If the energy in either signal path is above the SThreshold then the ValidSpeech flag is set to TRUE. This flag is used in the subsequent comparison steps.

If the ending Delayed Decision flag was previously set to TRUE, as described above, and if the ValidSpeech flag has also been set to TRUE then an end-of-speech message is returned and the state machine transitions back to the silence state 320. On the other hand, if the ValidSpeech flag has not been set to TRUE a message is sent to cancel the previous speech detection and the state machine transitions back to silence state 320.

Figure 10:
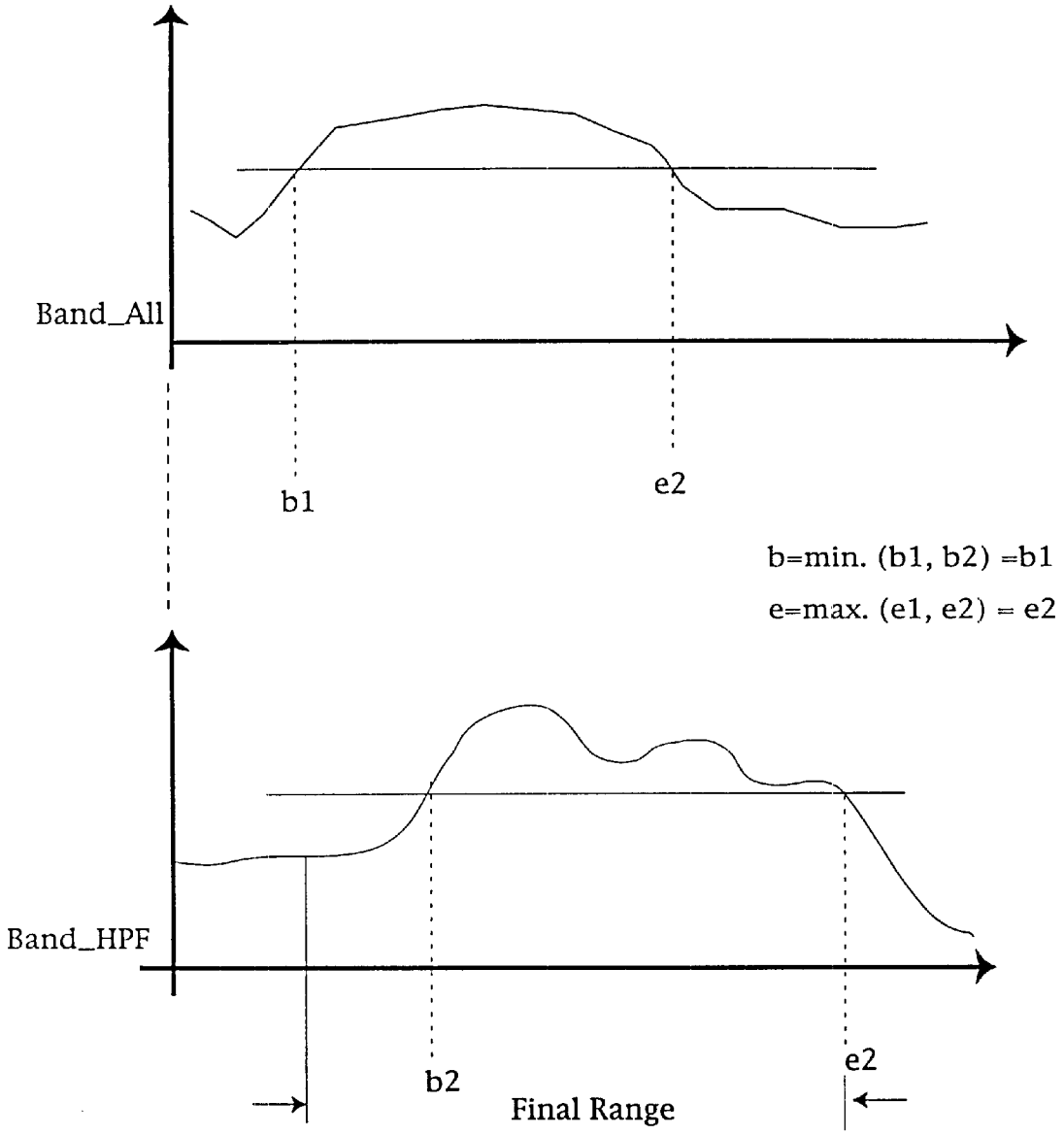
FIG. 10 is a collection of waveform diagrams illustrating how the multiband threshold analysis is combined to select the final range that corresponds to a speech present state.
Figure 11:
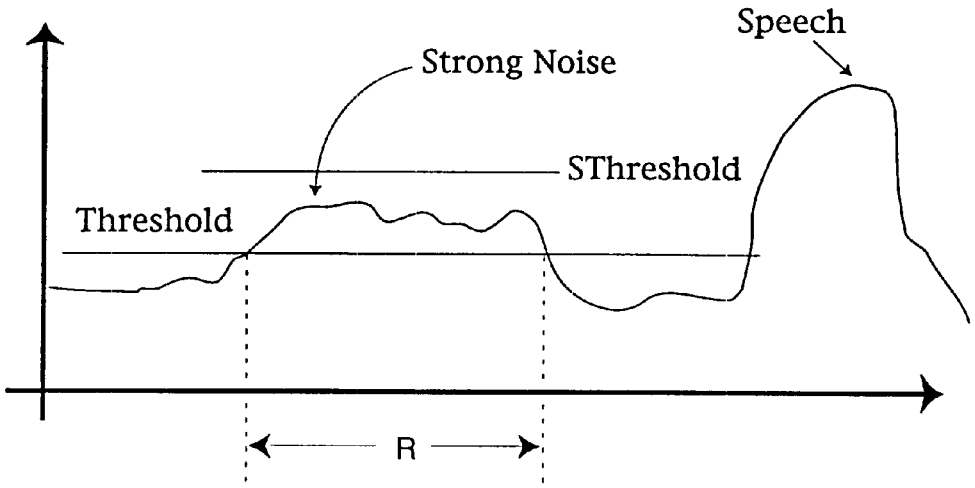
FIG. 11 is a waveform diagram illustrating the use of the S threshold in the presence of strong noise.

FIGS. 10 and 11 show how the various levels affect the state machine operation. FIG. 10 compares the simultaneous operation of both signal paths, the all-frequency band, Band_All, and the high-frequency band, Band_HPF. Note that the signal wave forms are different because they contain different frequency content. In the illustrated example the final range that is recognized as detected speech corresponds to the beginning of speech generated by the all-frequency band crossing the threshold at b1 and the end of speech corresponds to the crossing of the high-frequency band at e2. Different input waveforms would, of course, produce different results in accordance with the algorithm described in FIG. 4.

FIG. 11 shows how the strong threshold, SThreshold, is used to confirm the existence of ValidSpeech in the presence of a strong noise level. As illustrated, a strong noise that falls below SThreshold is responsible for region R that would correspond to a ValidSpeech flag being set to FALSE.

From the foregoing it will be understood that the present invention provides a system that will detect the beginning and ending of speech within an input signal, handling many problems encountered in consumer applications in noisy environments. While the invention has been described in its presently preferred form, it will be understood that the invention is capable of certain modification without departing from the spirit of the invention as set forth in the appended claims.

What is claimed is:

1. A speech detection system for examining an input signal to determine whether a speech signal is present or absent, comprising:

a frequency band splitter for splitting said input signal into a plurality of frequency bands, each band representing a band-limited signal energy corresponding to a different range of frequencies;

an energy comparator system for comparing the band-limited signal energy of said plurality of frequency bands with a plurality of thresholds such that each frequency band is compared with at least one threshold associated with that band;

a speech signal state machine coupled to said energy comparator system that switches:

(a) from a speech-absent state to a speech-present state when the band-limited signal energy of at least one of said bands is above at least one of its associated thresholds, and (b) from a speech-present state to a speech-absent state when the band-limited signal energy of at least one of said bands is below at least one of its associated thresholds;

a histogram data structure residing in computer memory accessible to said speech detection system wherein said histogram data structure initially has a size based at least in part on the energy level of the non-speech portion of the input signal, and wherein said histogram data structure is organized by a predetermined number of histogram steps having a step size based at least in part on a mean of accumulated historical data;

a histogram updating module operable to periodically update said histogram data structure based on a portion of the input signal having an energy level falling within the size of the histogram data structure, said histogram updating module further operable to adjust the size of said histogram data structure based on actual operating conditions wherein said histogram updating module periodically adjusts the step size to reflect a change in said mean, thereby affecting adjustment of the size of the histogram data structure based on actual operating conditions; and an adaptive threshold updating system that employs said histogram data structure to accumulate historical data indicative of a pre-speech silence portion of said input signal within at least one of said frequency bands such that an energy level of greatest magnitude among all energy levels of the historical data defines a noise floor, the updating system using the noise floor to adjust at least one of said plurality of thresholds used by said energy comparator, said historical data being initially limited to a non-speech portion of the input signal.

2. The system of claim 1 further comprising a separate adaptive threshold updating system associated with each of said frequency bands.

3. The system of claim 1 wherein said adaptive threshold updating system revises said plurality of thresholds based on the mean and variance of energies within each of said frequency bands.

4. The system of claim 1 further comprising a partial speech detection system responsive to a predetermined jump in the rate of change in at least one of said plurality of thresholds, said partial speech detection system inhibiting said state machine from switching to a speech-present state if the ratio before said jump to after said jump of the average value of said one threshold exceeds a predetermined value.

5. The system of claim 1 further comprising a multiple threshold system that defines:

a first threshold as a predetermined offset above the noise floor;

a second threshold as a predetermined percent of said first threshold, said second threshold being less than said first threshold; and a third threshold as a predetermined multiple of said first threshold, said third threshold being greater than said first threshold; and wherein said first threshold controls switching from said speech-absent state to said speech-present state; and wherein said second and third thresholds control switching from said speech-present state to said speech-absent state.

6. The system of claim 5 wherein said state machine switches from said speech-present state to said speech-absent state if the band-limited signal energy of at least one of said bands is below said second threshold and if the band-limited signal energy of at least one of said bands is below said third threshold.

7. The system of claim 1 further comprising a delayed decision buffer that stores data representing a predetermined time increment of said input signal and that inhibits state machine switching from said speech-absent state to said speech-present state if the band-limited signal energy of at least one of said plurality of frequency bands does not exceed at least one threshold throughout said predetermined time increment.

8. A method of determining whether a speech signal is present or absent in an input signal, comprising the steps of:

splitting said input signal into a plurality of frequency bands, each band representing a band-limited signal energy corresponding to a different range of frequencies;

comparing the band-limited signal energy of said plurality of frequency bands with a plurality of thresholds such that each frequency band is compared with at least one threshold associated with that band;

accumulating historical data indicative of a pre-speech portion of said input signal within at least one of said frequency bands, using said accumulated historical data to define a noise floor based on an energy level of greatest magnitude among all energy levels of said accumulated historical data, and using the noise floor to adjust at least one of said plurality of thresholds, said historical data being initially limited to a non-speech portion of the input signal;

periodically updating a histogram data structure based on a portion of the input signal having an energy level falling within the size of the histogram data structure, said histogram data structure initially having a size based at least in part on the energy level of a non-speech portion of said input signal, wherein said histogram data structure is organized by a predetermined number of histogram steps having a step size based at least in part on a mean of said accumulated historical data, said updating further adjusting the size of said histogram data structure based on actual operating conditions wherein said histogram updating module periodically adjusts the step size to reflect a change in said mean, thereby affecting adjustment of the size of the histogram data structure based on actual operating conditions; and determining that:

(a) a speech-present state exists when the band-limited signal energy of at least one of said bands is above at least one of its associated thresholds, and (b) a speech-absent state exists when the band-limited signal energy of at least one of said bands is below at least one of its associated thresholds, wherein at least one threshold confirms a validity of said speech-present state determination.

9. The method of claim 8 further comprising the step of adaptively updating at least one of said plurality of thresholds separately for each of said frequency bands.

10. The method of claim 8 further comprising the step of revising said plurality of thresholds based on the mean and variance of energies within each of said frequency bands.

11. The method of claim 8 further comprising the step of detecting a predetermined jump in the rate of change in at least one of said plurality of thresholds and determining that said speech-present state does not exist if the ratio before said jump to after said jump of the average value of said one threshold exceeds a predetermined value.

12. The method of claim 8 further comprising the step of defining:

first threshold as a predetermined offset above the noise floor;

a second threshold as a predetermined percent of said first threshold, said second threshold being less than said first threshold; and a third threshold as a predetermined multiple of said first threshold, said third threshold being greater than said first threshold; and determining said speech-present state to exist based on said first threshold and determining said speech-absent state to exist based on said second and third thresholds.

13. The method of claim 12 wherein said speech-absent state is determined to exist if the band-limited signal energy of at least one of said bands is above said second threshold and if the band-limited signal energy of at least one of said bands is above said third threshold.

14. The method of claim 8 wherein, in said determining step, said speech-present state does not exist if the band-limited signal energy of at least one of said plurality of frequency bands does not exceed at least one threshold throughout a predetermined increment of time.

15. An adaptive threshold updating system for use with a speech detection system, said system comprising:

a histogram data structure residing in computer memory accessible to said speech detection system wherein said histogram data structure initially has a size based at least in part on the energy level of the non-speech portion of the input signal, and wherein said histogram data structure is organized by a predetermined number of histogram steps having a step size based at least in part on a mean of accumulated historical data;

a histogram updating module operable to periodically update said histogram data structure based on a portion of the input signal having an energy level falling within the size of the histogram data structure, said histogram updating module further operable to adjust the size of said histogram data structure based on actual operating conditions wherein said histogram updating module periodically adjusts the step size to reflect a change in said mean, thereby affecting adjustment of the size of the histogram data structure based on actual operating conditions;

accumulated historical data residing in said histogram data structure, said accumulated historical data indicative of a pre-speech silence portion of an input signal within at least one frequency band split from the input signal, the frequency band representing a band-limited signal energy corresponding to a different range of frequencies, said accumulated historical data initially limited to a non-speech portion of the input signal; and a threshold updating module operable to define a noise floor based on an energy level of greatest magnitude among all energy levels of said accumulated historical data, and further operable to use the noise floor to adjust at least one threshold used by said speech detection system.

16. The system of claim 15, wherein said histogram updating module is further operable to adjust said accumulated historical data by introducing a forgetting factor to periodically diminish said accumulated historical data, thereby permitting an emphasis of recently accumulated historical data in determination of the noise floor.

* * * * *

UNITED STATES PATENT AND TRADEMARK OFFICE

CERTIFICATE OF CORRECTION

PATENT NO. : 6,480,823 B1
DATED : November 12, 2002
INVENTOR(S) : Yi Zhao et al.

It is certified that error appears in the above-identified patent and that said Letters Patent is hereby corrected as shown below:

Title page, Item [54] and Column 1, lines 1-2,
"SPEECH DETECTION FOR NOISY CONDITIONS" should be -- SPEECH DETECTION SYSTEM FOR NOISY CONDITIONS --

Signed and Sealed this

Twenty-fourth Day of June, 2003

JAMES E. ROGAN
*Director of the United States Patent and Trademark Office*